US010494134B2

(12) United States Patent
Murase et al.

(10) Patent No.: US 10,494,134 B2
(45) Date of Patent: Dec. 3, 2019

(54) SQUEEZE CONTAINER

(71) Applicants: TAKEUCHI PRESS INDUSTRIES CO., LTD., Toyama (JP); SENJU PHARMACEUTICAL CO., LTD., Osaka (JP)

(72) Inventors: Takahiro Murase, Toyama (JP); Tadashi Otsuka, Hyogo (JP)

(73) Assignees: TAKEUCHI PRESS INDUSTRIES CO., LTD., Toyama (JP); SENJU PHARMACEUTICAL CO., LTD., Osaka (JP)

( * ) Notice: Subject to any disclaimer, the term of this patent is extended or adjusted under 35 U.S.C. 154(b) by 0 days.

(21) Appl. No.: 15/777,113

(22) PCT Filed: Nov. 11, 2016

(86) PCT No.: PCT/JP2016/083586
§ 371 (c)(1),
(2) Date: Aug. 21, 2018

(87) PCT Pub. No.: WO2017/086256
PCT Pub. Date: May 26, 2017

(65) Prior Publication Data

US 2018/0354672 A1 Dec. 13, 2018

(30) Foreign Application Priority Data

Nov. 20, 2015 (JP) ..... 2015-227600

(51) Int. Cl.
*B65D 1/32* (2006.01)
*B65D 35/02* (2006.01)

(52) U.S. Cl.
CPC ..... *B65D 1/32* (2013.01); *B65D 35/02* (2013.01)

(58) Field of Classification Search
CPC ..... B65D 1/32; B65D 35/02
See application file for complete search history.

(56) References Cited

U.S. PATENT DOCUMENTS 2,688,424 A * 9/1954 Keiter ..... G01F 11/082 165/913
3,366,284 A * 1/1968 Marona ..... G01F 11/082 222/211

(Continued)

FOREIGN PATENT DOCUMENTS

JP 2001058656 A * 3/2001 ..... B65D 35/02
JP 2001-120638 A 5/2001

(Continued)

OTHER PUBLICATIONS

International Search Report issued in corresponding International Application No. PCT/JP2016/083586, dated Jan. 31, 2017.

*Primary Examiner* — Frederick C Nicolas
(74) *Attorney, Agent, or Firm* — McDermott Will & Emery LLP

(57) ABSTRACT

The present invention provides a squeeze container capable of reducing remaining contents without greatly compressing and deforming the vicinity of a shoulder portion thereof. The present invention relates to a squeeze container for discharging contents by compressing a body portion back and forth from the outside, wherein the body portion has a shape of a polygon or an oval tapered in a left-right direction in plan view, the body portion includes a pair of front-and-back pressing portions that is disposed to face each other so as to flatten the polygonal or the oval in the left-right direction by being compressed back and forth so as to be brought into close contact with each other, and a pair of left-and-right tapered portions connecting the pressing portions to each other, and a pair of front-and-back V-shaped grooves are provided between each of the pressing portions of the body (Continued)

portion and the shoulder portion so as to face each other while being recessed in a central axis direction of the body portion and having a groove bottom formed by an upper bending line extending substantially horizontally.

11 Claims, 6 Drawing Sheets

(56) References Cited

U.S. PATENT DOCUMENTS

| | | | | |
|---|---|---|---|---|
| 3,552,605 | A * | 1/1971 | Hein | B65D 47/18 222/207 |
| 6,279,780 | B1 * | 8/2001 | Rousselet | B65D 35/02 222/107 |
| 6,875,201 | B1 | 4/2005 | Kawashima et al. | |
| 6,938,788 | B2 * | 9/2005 | White | B65D 1/32 215/381 |
| 7,172,087 | B1 * | 2/2007 | Axe | B65D 1/32 215/381 |
| 7,198,165 | B2 * | 4/2007 | Zhang | B65D 1/0223 215/381 |
| 7,357,267 | B1 * | 4/2008 | Shimada | B65D 1/0292 215/381 |
| 8,016,162 | B2 * | 9/2011 | Cleary | B65D 1/0223 215/216 |
| 9,833,799 | B2 * | 12/2017 | Minnette | B05B 11/047 |
| 2008/0302830 | A1 | 12/2008 | Loth-Krausser | |
| 2011/0024426 | A1 | 2/2011 | Kokubo | |
| 2015/0328653 | A1 | 11/2015 | Minnette et al. | |

FOREIGN PATENT DOCUMENTS

| | | | |
|---|---|---|---|
| JP | 2003-137259 | A | 5/2003 |
| JP | 3823217 | B2 | 9/2006 |
| JP | 2009-249007 | A | 10/2009 |
| WO | 2006/011473 | A1 | 2/2006 |

* cited by examiner

SQUEEZE CONTAINER

CROSS REFERENCE TO RELATED APPLICATIONS

This application is the U.S. National Phase under 35 U.S.C. § 371 of International Application No. PCT/JP2016/083586, filed on Nov. 11, 2016, which claims the benefit of Japanese Application No. 2015-227600, filed on Nov. 20, 2015, the entire contents are hereby incorporated by reference.

TECHNICAL FIELD

The present invention relates to a squeeze container for discharging contents by compression operation.

BACKGROUND ART

A typical squeeze container usually discharges contents by compressing its body portion. However, compressing only the body portion causes a problem that a large amount of contents finally remains in a corner formed between a shoulder portion and the body portion.

To discharge the contents in the corner, it is necessary to compress the vicinity of the shoulder portion to greatly deform the portion. Specifically, the portion needs to be folded such that an inner surface of the shoulder portion and an inner surface of the body portion are brought into contact with each other, or the shoulder portion needs to be squeezed. However, the shoulder portion is formed thick in many cases, so that a large force is required for compressing and deforming the vicinity of the shoulder portion.

Patent Literature 1 discloses that a fold is previously formed in the vicinity of the shoulder portion so that the vicinity of the shoulder portion can be compressed and deformed even with a small force.

CITATIONS LIST

Patent Literature

Patent Literature 1: Japanese Patent No. 3,823,217

SUMMARY OF INVENTION

Technical Problems

However, the shape of the squeeze container (tube container) of Patent Literature 1 is not so different from that of the conventional squeeze container, so that there is no change in the fact that a lot of contents are located at a corner between the shoulder portion and the body portion. Thus, the vicinity of the shoulder portion needs to be always compressed and deformed greatly to reduce the remaining contents, and it cannot be said that usability is good.

When the vicinity of the shoulder portion is greatly deformed, a neck portion may be deformed together. Therefore, when a functional component such as a nozzle and a check valve is separately attached to the neck portion, various problems such as coming-off of the component or leakage of contents from an unintended portion may be caused.

Therefore, it is an object of the present invention to provide a squeeze container capable of reducing remaining contents without greatly compressing and deforming the vicinity of a shoulder portion thereof.

Solutions to Problems

A squeeze container of the present invention includes an open cylindrical neck portion, a shoulder portion extending substantially horizontally from a base end of the neck portion, a body portion provided below the shoulder portion, and a bottom portion provided below the body portion, wherein the body portion is compressed back and forth from outside to discharge contents. The body portion has a shape of a polygon or an oval tapered in a left-right direction in plan view. The body portion includes a pair of front-and-back pressing portions that are disposed to face each other so as to flatten the polygonal or the oval in the left-right direction by being compressed back and forth, and a pair of left-and-right tapered portions connecting the pressing portions to each other, and a pair of front-and-back V-shaped grooves are provided between each of the pressing portions of the body portion and the shoulder portion so as to face each other while being recessed in a central axis direction of the body portion and having a groove bottom formed by an upper bending line extending substantially horizontally.

It is preferable that the shoulder portion includes a pair of front-and-back main shoulder edges facing the corresponding pair of front-and-back pressing portions and a pair of left-and-right side shoulder edges connecting the corresponding opposite ends of the front-and-back main shoulder edges to each other, the V-shaped grooves are provided symmetrically front and back between the main shoulder edges of the shoulder portion and the corresponding pressing portions of the body portion, inclined portions each in a shape tapered downward outside are provided symmetrically left and right between the side shoulder edges of the shoulder portion and the corresponding tapered portions of the body portion, the inclined portion has a shape tapered from the side shoulder edge toward an end portion of the tapered portion, and the upper bending line extends to a tapered apex of the inclined portion or to a lower vicinity of the tapered apex.

It is also preferable that the bottom portion extends substantially horizontally, and a pair of front-and-back second V-shaped grooves are provided so as to face each other between each of the pressing portions of the body portion and the bottom portion while being recessed in the central axis direction of the body portion and having a groove bottom formed by a lower bending line extending substantially horizontally.

It is preferable that the bottom portion includes a pair of front-and-back main bottom edges facing the corresponding pair of front-and-back pressing portions and a pair of left-and-right side bottom edges connecting the corresponding opposite ends of the front-and-back main bottom edges to each other, the second V-shaped grooves are provided symmetrically front and back between the main bottom edges of the bottom portion and the corresponding pressing portions of the body portion, second inclined portions each in a shape tapered upward outside are provided symmetrically left and right between the side bottom edges of the bottom portion and the corresponding tapered portions of the body portion, the second inclined portion has a shape tapered from the side bottom edge toward the end portion of the tapered portion, and the lower bending line extends to a tapered apex of the second inclined portion or to an upper vicinity of the tapered apex.

It is also preferable that a leg portion extending downward is provided in the bottom portion.

In addition, it is preferable that a droplet nozzle is provided in the neck portion.

Further, it is preferable that the body portion is configured so as not to be restored after being compressed. Specifically, it is preferable that the neck portion is provided with a check valve for allowing a flow from inside to outside and blocking a flow from outside to inside, or that the squeeze container is made of a plastic deformable material.

It is also preferable that the neck portion includes a cylindrical neck portion main body and a narrowed portion reduced in diameter below the neck portion main body.

In addition, it is preferable that an internal space of the squeeze container is filled with medicine by about 15 to 85% of a full volume.

Advantageous Effects of Invention

The squeeze container of the present invention includes the V-shaped groove formed between the pressing portion of the body portion and the shoulder portion, so that an angle of a corner formed by the shoulder portion and the body portion is smaller than that of a typical squeeze container. As a result, a space formed at the corner is small. This enables the amount of contents positioned at the corner to be reduced from the beginning.

The upper bending line of the V-shaped groove naturally deforms toward an inner surface of the shoulder portion with compression operation for flattening the body portion, so that the space generated at the corner can be further reduced to enable remaining contents to be reduced.

Since the V-shaped groove separates the shoulder portion from the pressing portion of the body portion, the compression operation is less likely to affect the shoulder portion, and thus deformation of the neck portion can be reduced.

In addition, the pair of V-shaped grooves secure rigidity against compression from the left-right direction, so that it is possible to suppress excessive discharge of the contents due to compression from the left-right direction.

When the upper bending line extends to the tapered apex of the inclined portion or to the lower vicinity of the tapered apex, the pair of V-shaped grooves serve as resistance for reducing deformation of the inclined portion even if an unexpected external force acts on the inclined portion, such as dropping the squeeze container. As a result, excessive discharge of the contents can be suppressed.

Compression of the pressing portion causes the inclined portion to deform so as to spread in the left-right direction, so that the flattened body portion can be drawn to the shoulder portion. As a result, the space generated at the corner can be further reduced.

When the second V-shaped groove is formed between the pressing portion and the bottom portion of the body portion, it is possible to reduce the contents remaining on a bottom portion side and to suppress excessive discharge of the contents due to compression from the left-right direction. In addition, the V-shaped grooves formed at two upper and lower portions also achieve a good aesthetic appearance.

When the lower bending line extends to the tapered apex of the second inclined portion or to the upper vicinity of the tapered apex, the second V-shaped grooves serve as resistance for reducing deformation of the second inclined portion even if a pressing force acts on the second inclined portion. As a result, excessive discharge of the contents can be suppressed.

When the leg portion extending downward is provided in the bottom portion, the container can stand by itself.

When a droplet nozzle is provided in the neck portion, the contents can be dripped drop by drop.

When the body portion is configured so as not to be restored after being compressed, specifically, a check valve is provided, invasion of bacteria or the like can be suppressed. When the squeeze container is made of a plastic deformable material, the squeeze container can be easily deformed to easily discharge the contents. Any one of the cases enables flattening of the container with compression operation to be promoted.

When the neck portion includes the neck portion main body and the narrowed portion, the neck portion can be improved in strength to enable deformation of the neck portion to be reduced.

When the internal space of the squeeze container is filled with medicine by about 15 to 85% of a full volume and the rest of the internal space is filled with gas such as inert gas, all the contents can be squeezed without completely compressing and deforming the container. In particular, this is preferable for a squeeze container provided with a droplet nozzle, because the container is turned upside down and used.

BRIEF DESCRIPTION OF DRAWINGS

FIG. 1A is a front view, FIG. 1B is a side view, FIG. 1C is a plan view, and FIG. 1D is a bottom view.

FIG. 3A is a schematic side view, and FIG. 3B is a schematic front view.

FIG. 4A is a front view, FIG. 4B is a side view, FIG. 4C is a plan view, and FIG. 4D is a bottom view.

FIG. 5A is a front view, FIG. 5B is a side view, FIG. 5C is a plan view, and FIG. 5D is a bottom view.

FIG. 6A is a front view, and FIG. 6B is a side view.

DESCRIPTION OF EMBODIMENTS

Figure 1A:
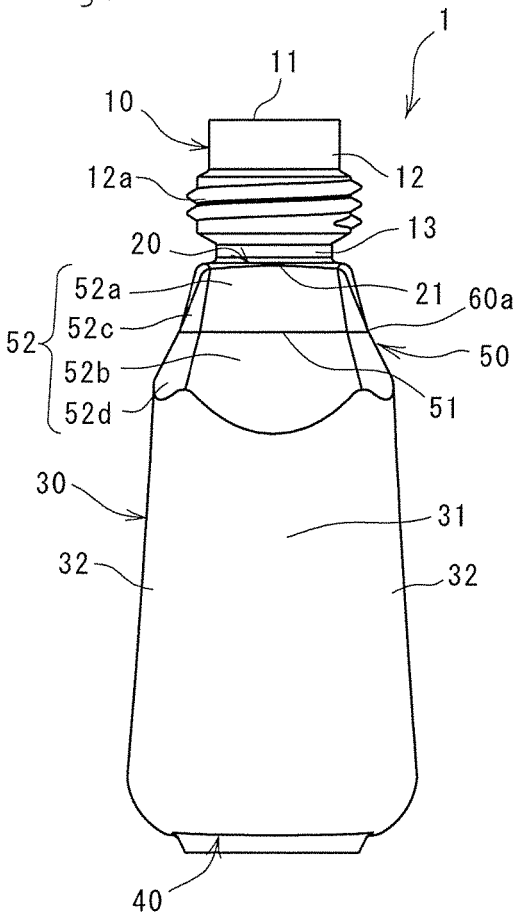
FIGS. 1A to 1D illustrate an embodiment of a squeeze container of the present invention, where

Next, an embodiment of a squeeze container 1 of the present invention will be described in detail. As illustrated in FIG. 1, the squeeze container 1 of the present invention includes an open cylindrical neck portion 10, a shoulder portion 20 extending substantially horizontally from a base end of the neck portion 10, a body portion 30 provided below the shoulder portion 20, and a bottom portion 40 provided below the body portion 30.

Figure 1B:
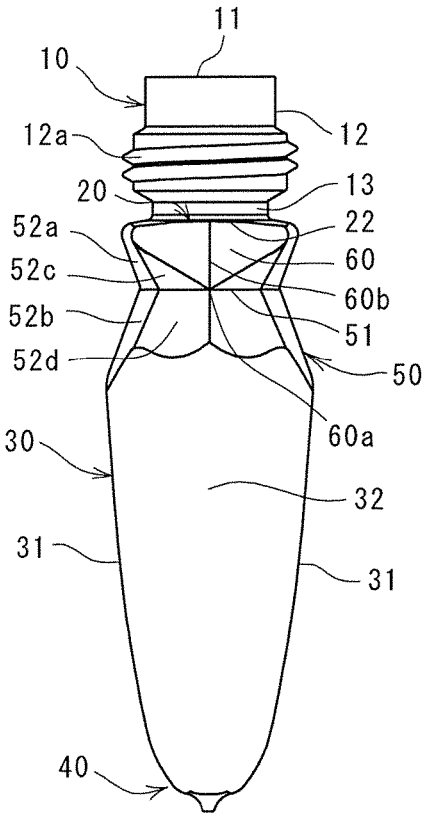
Figure 2:
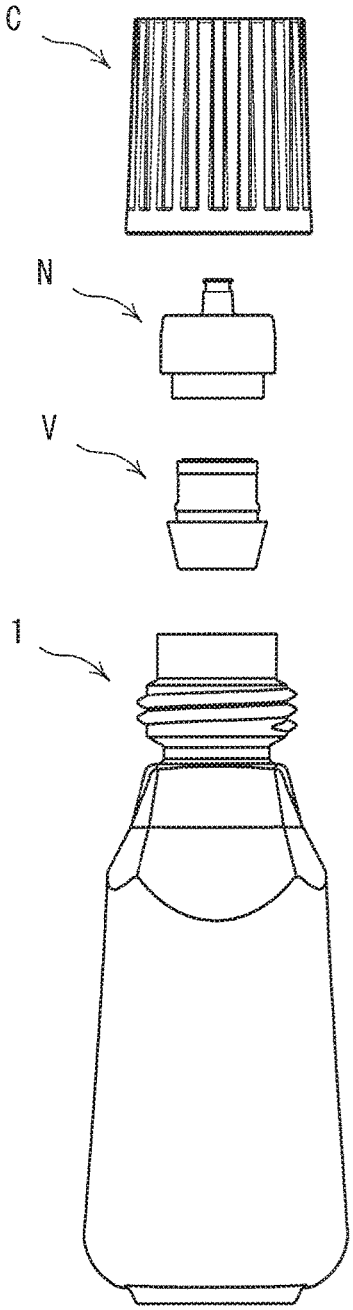
FIG. 2 is a front view illustrating a cap, a droplet nozzle, and a check valve, attached to a squeeze container.

As illustrated in FIGS. 1A and 1B, the neck portion 10 has an opening 11 for discharging contents, and includes a cylindrical neck portion main body 12 and a narrowed portion (reduced diameter portion) 13 provided below the neck portion main body 12. The neck portion main body 12 is provided in its outer peripheral surface with a thread 12*a* for attaching a cap C that closes the opening 11. As illustrated in FIG. 2, in addition to the cap C, a functional component such as a droplet nozzle N capable of dripping the contents drop by drop, a check valve V for preventing entry of substances from outside air into the container, and the like are appropriately attached to the neck portion 10. The narrowed portion 13 is configured to increase strength of the neck portion 10 and reduce deformation of the neck portion 10.

Figure 1C:
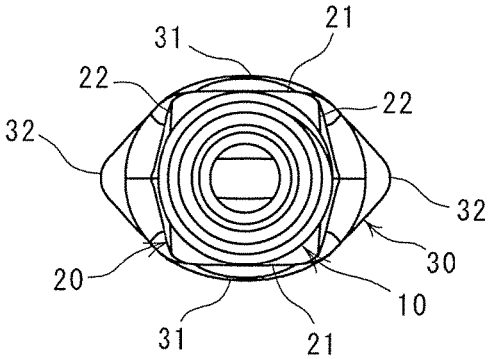

The shoulder portion 20 extends from a lower end of the narrowed portion 13 of the neck portion 10 and is formed in a substantially quadrangular shape in plan view as illustrated in FIG. 1C. The shoulder portion 20 is thicker than the body portion 30, so that rigidity in front-back and left-right directions is secured. Two sides parallel to each other of four sides constituting a substantially quadrangle face the pressing portion 31 of the body portion 30 described later, that is, are disposed corresponding to (in juxtaposition) the vertical direction. For the sake of simplicity of explanation, two sides facing the pressing portion 31 are each referred to as a main shoulder edge 21, and two sides connecting the corresponding opposite ends of the main shoulder edges 21 to each other are each referred to as a side shoulder edge 22.

Figure 1D:
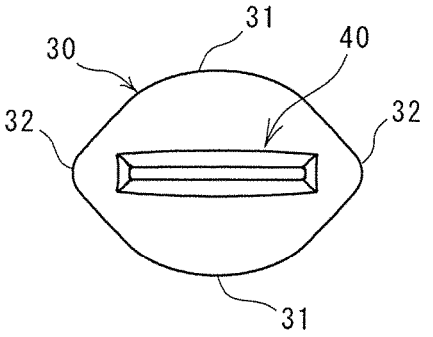

As illustrated in FIGS. 1C and 1D, the body portion 30 has a substantially oval shape (spindle shape) tapered in the left-right direction in plan view, and has a cylindrical shape long in the vertical direction as a whole. In the present embodiment, the body portion 30 gradually spreads downward in front view, and narrows downward in side view. However, the body portion 30 may be straight. The body portion 30 includes a pair of front-and-back pressing portions 31 and 31 disposed while facing each other so as to flatten the substantially oval shape in plan view in the left-right direction by being compressed in the front-back direction so as to bring inner surfaces of the respective pressing portions into close contact with each other, and a pair of left-and-right tapered portions 32 and 32 connecting the pressing portions 31 and 31 to each other. As illustrated in FIGS. 1A and 1B, an upper bending line 51 continuous in a circumferential direction in a substantially horizontal direction is formed between the shoulder portion 20 and the pressing portion 31 of the body portion 30. The upper bending line 51 is recessed in a central axis direction of the body portion 30, and a V-shaped groove 50 is formed by panel portions 52 positioned above and below the upper bending line 51.

As illustrated in FIGS. 1A and 1B, the panel portions 52 includes a first panel portion 52*a* formed between the main shoulder edge 21 of the shoulder portion 20 and the upper bending line 51, a second panel portion 52*b* formed between the upper bending line 51 and the pressing portion 31 of the body portion 30, i.e., below the first panel portion 52*a*, a third panel portion 52*c* formed between the side shoulder edge 22 of the shoulder portion 20 and the upper bending line 51, i.e., on right and left sides of the first panel portion 52*a*, and a fourth panel portion 52*d* formed between the upper bending line 51 and the tapered portion 32 of the body portion 30, i.e., below the third panel portion 52*c*.

Figure 3A:
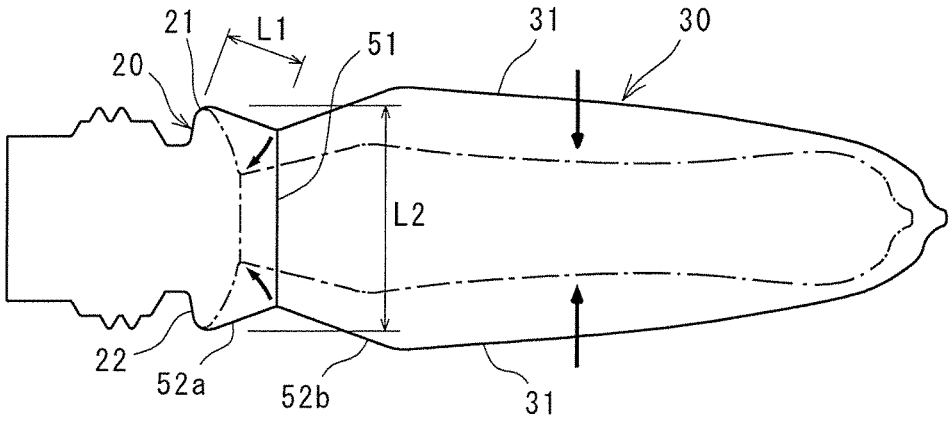
FIGS. 3A and 3B illustrate a compressive deformation of a squeeze container, where

As illustrated in FIG. 3A, the first panel portion 52*a* is formed such that a vertical length L1 (a length from the main shoulder edge 21 of the shoulder portion 20 to the upper bending line 51) is less than half of a length L2 of the side shoulder edge 22 of the shoulder portion 20.

The third panel portion 52*c* has a substantially triangular shape in side view, and an inclined portion 60 is positioned above the third panel portion 52*c*, as illustrated in FIG. 1B.

Ridgeline portions of the respective panel portions 52*a*, 52*b*, 52*c*, and 52*d*, and vicinities of four corners of the shoulder portion 20 are each not limited to an angular shape, and may be a slightly rounded shape. In addition, each of the panel portions 52*a*, 52*b*, 52*c*, 52*d* may be smoothly curved outward or inward of the container. From a viewpoint of securing lateral rigidity with the pair of V-shaped grooves 50 and 50, it is preferable that the portion in contact with the upper bending line 51 is not curved.

As described above, the inclined portion 60 connects the side shoulder edge 22 of the shoulder portion 20 and the upper side of each of the third panel portions 52*c* provided symmetrically left and right in side view, and has a shape tapered downward outside, specifically, a substantially triangular shape, as illustrated in FIG. 1B. The inclined portion 60 tapers from the side shoulder edge 22 toward an end portion of the tapered portion 32. Then, the upper bending line 51 extends (is connected) to a tapered apex 60*a* of the inclined portion 60. The apex 60*a* is not necessarily connected to the upper bending line 51 as long as it is positioned near the upper bending line 51. A folding line 60*b* is vertically provided at a central portion of the inclined portion 60, and the folding line 60*b* may also be slightly rounded. The inclined portion 60 may be smoothly curved outward or inward of the container without being provided with the folding line 60*b*, or may be even more flat.

The bottom portion 40 has a linear shape as illustrated in FIG. 1D. This is formed by pinching off a lower end of the cylindrical body portion 30.

The squeeze container 1 with the above structure is manufactured by blow molding with a flexible polyethylene resin, for example. After the container is molded, the inside of the container is filled with a liquid medicine such as eye drops as contents. The amount of filled contents is about 15 to 85% of a full volume (usually, about 2 to 6 mL for a container with a full volume of about 7 to 12 mL). If the amount of filled contents is less than about 15%, the contents are difficult to be discharged when the squeeze container is turned upside down to be used, and if the amount of filled contents is more than about 85%, the liquid medicine tends to remain, whereby they are not preferable. Inert gas may be filled in the space, other than the contents, inside the container to prevent the contents from being deteriorated. After the contents are filled, a droplet nozzle N for discharging the contents drop by drop, a check valve V for preventing substances from entering the container from outside air, a cap C for protecting the droplet nozzle N, and the like are appropriately attached to the neck portion 10.

To discharge the contents from the squeeze container 1, the pressing portion 31 of the body portion 30 is compressed back and forth. When the check valve V is attached to the neck portion 10, the pressing portion 31 of the body portion 30 deforms so as to largely dent in a front-back direction in accordance with discharge of the contents. However, compression of the body portion 30 is less likely to affect the shoulder portion 20 because the V-shaped groove 50 separates the shoulder portion 20 from the pressing portion 31 of the body portion 30. As a result, the deformation of the neck portion 10 due to the compression of the body portion 30 is reduced. This prevents troubles such as coming-off of the droplet nozzle N and inactivation of the check valve V.

As the pressing portions 31 and 31 are brought close to each other by compression, the upper bending lines 51 and 51 also move toward each other. Then, the upper bending line 51 moves toward the shoulder portion 20 around the main shoulder edge 21 as the center of rotation because an upper portion of the first panel portion 52*a* is connected to the main shoulder edge 21 of the shoulder portion 20. This causes a space generated at the corner between the shoulder portion 20 and the first panel portion 52*a* to be reduced (an angle of the corner is reduced) as illustrated in FIG. 3A, so that the contents located at the corner are reduced naturally.

Figure 3B:
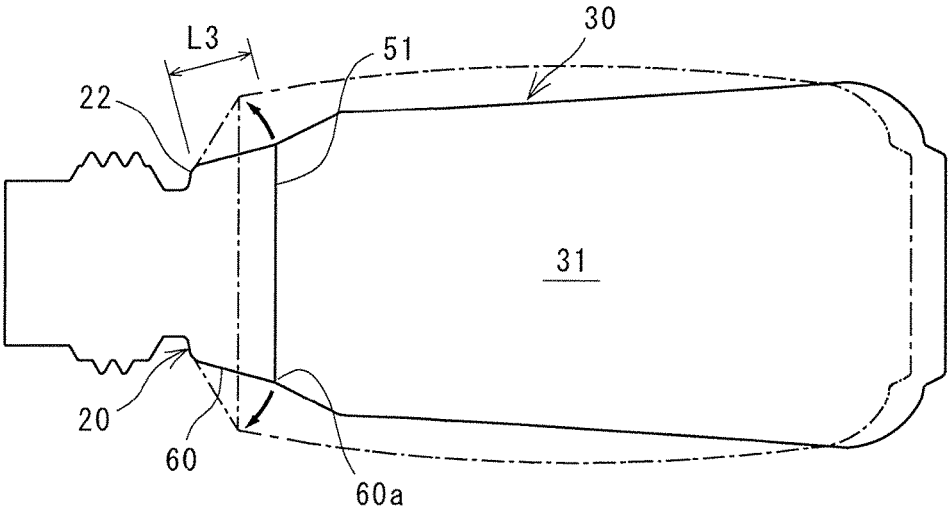
Figure 4A:
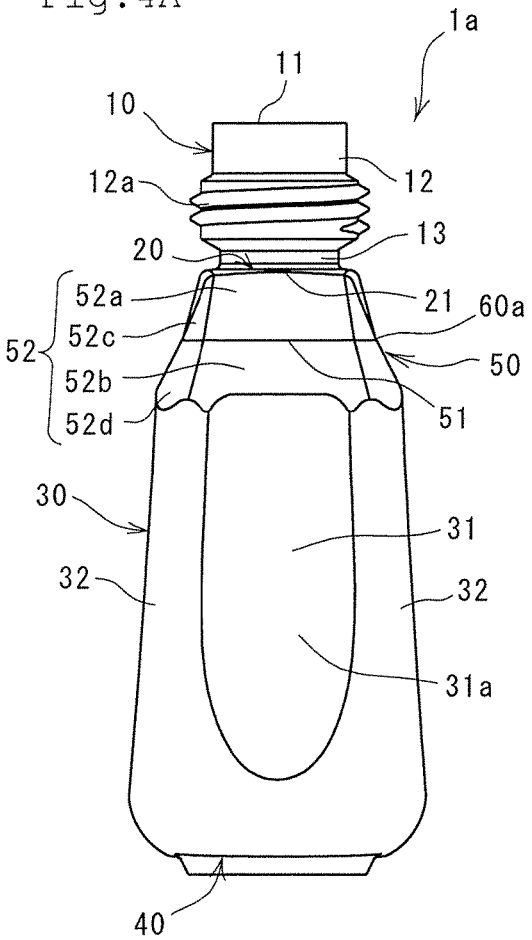
FIGS. 4A to 4D illustrate another embodiment of the squeeze container of the present invention, where
Figure 4B:
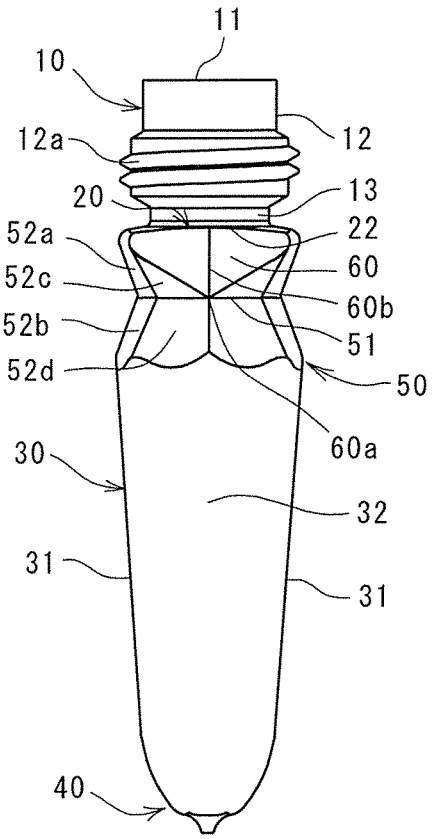
Figure 4C:
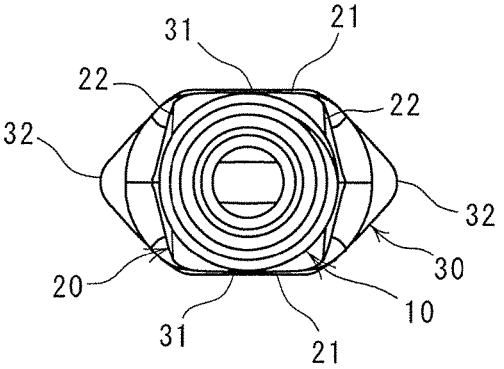
Figure 4D:
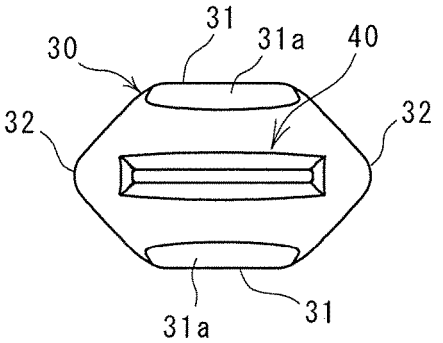

This effect is more prominent because the upper bending line 51 is continuous in the circumferential direction and the apex 60*a* of the inclined portion 60 and the upper bending line 51 intersect or approach each other. That is, when the pressing portion 31 is compressed in the front-back direction, the upper bending line 51 expands in the left-right direction as illustrated in FIG. 3B. Accordingly, the apex 60*a* of the inclined portion 60 moves in the left-right direction so as to expand, and the entire body portion 30 approaches the shoulder portion 20 by the amount of expansion in the left-right direction (the flattened body portion 30 is drawn to the shoulder portion 20) because a length L3 of the inclined portion 60 from the upper bending line 51 to the side shoulder edge 22 is always constant. This causes the space generated between the inclined portion 60 and the third panel portion 52*c* to be reduced, so that the space between the first panel portion 52*a* and the shoulder portion 20 is further reduced. As a result, the remaining contents are naturally reduced.

Dropping the squeeze container 1 or erroneous compression operation may sometimes cause the inclined portion 60 and the tapered portion 32 of the body portion 30 to be compressed from the left-right direction. In this case, the apex 60*a* of the inclined portion 60 moves in the central axis direction of the body portion 30, so that the entire body portion 30 moves away from the shoulder portion 20, contrary to the above phenomenon. At the same time, the V-shaped groove 50 deforms so as to reduce its depth, so that the space generated at the corner between the shoulder portion 20 and the first panel portion 52*a* increases (the angle of the corner increases). Thus, excess discharge of the contents is suppressed even if the squeeze container 1 is compressed. Deforming the squeeze container 1 to such an extent that the apex 60*a* of the inclined portion 60 moves further inward may cause a large pressure to be applied to the contents, however, there is little concern since the rigidity in the left-right direction is secured by the pair of V-shaped grooves 50 and 50.

The squeeze container 1 of the present invention has the space between the shoulder portion 20 and the body portion 30 that is initially reduced by the V-shaped groove 50, and thus the amount of the contents located near the shoulder portion 20 is less than that of a typical squeeze container. Thus, it is not always necessary to greatly deform the vicinity of the shoulder portion 20 as long as a certain amount of the contents is allowed to remain.

In the present embodiment, inert gas is filled in the container, so that all the contents can be discharged by using the container in an inverted state (the neck portion 10 faces downward) where the contents are always located in the neck portion 10 even when the container is not compressed completely.

FIG. 4 illustrate a squeeze container 1*a* that is a modification of the squeeze container 1 illustrated in FIG. 1. The squeeze container 1*a* is different from the squeeze container 1 of FIG. 1 in that a flat portion 31*a* is provided at a pressing portion 31 of a body portion 30. The flat portion 31*a* is formed by flattening an apex portion in the minor axis direction of the body portion 30 that is formed in an oval shape in plan view so as to be substantially parallel to the major axis direction. Thus, the body portion 30 has a planar shape acquired by cutting out the apexes of the oval in the minor axis direction (a flat oval shape, a bale type, and an oval type), as illustrated in FIGS. 4C and 4D. In addition, the flat portion 31*a* is provided so that its upper portion protrudes toward a second panel 52*b* as illustrated in FIG. 4A, and thus a ridgeline portion of a lower end portion of the second panel 52*b* is slightly different from that of FIG. 1. Other structures are substantially the same as those in FIG. 1, so that the same reference numerals are given, and a detailed description thereof is omitted.

Providing the flat portion 31*a* as described above allows fingers to easily hold the flat portion 31*a*, so that the container can be easily held. In addition, the container can be easily compressed (easily squeezed), so that the container can be easily squeezed evenly. In the squeeze container 1*a*, container internal pressure may be reduced to fill contents. This can assist a check function of a check valve V. While reduction in pressure inside a container may cause the container to be irregularly dented to impair its appearance, the squeeze container 1*a* can reduce deformation of other portions because the flat portion 31*a* mainly deforms so as to bend inward. As a result, dent deformation of the container due to negative pressure inside the container is inconspicuous.

FIG. 5 illustrates a squeeze container 2 of another embodiment of the present invention. The squeeze container 2 includes a body portion 30 in the shape of a hexagon tapered in the left-right direction in plan view as illustrated in FIG. 5C. The squeeze container 2 also includes a bottom portion 40 extending substantially horizontally, a shoulder portion 20 have substantially the same shape in plan view as that of the bottom portion 40, and a body portion 30 formed in a straight shape, as illustrated in FIGS. 5A and 58. A V-shaped groove (second V-shaped groove) 70 is also provided between the bottom portion 40 and a pressing portion 31 of the body portion 30. The present embodiment is greatly different from the previous embodiment in the respects above. Thus, this difference will be described in particular.

Figure 5A:
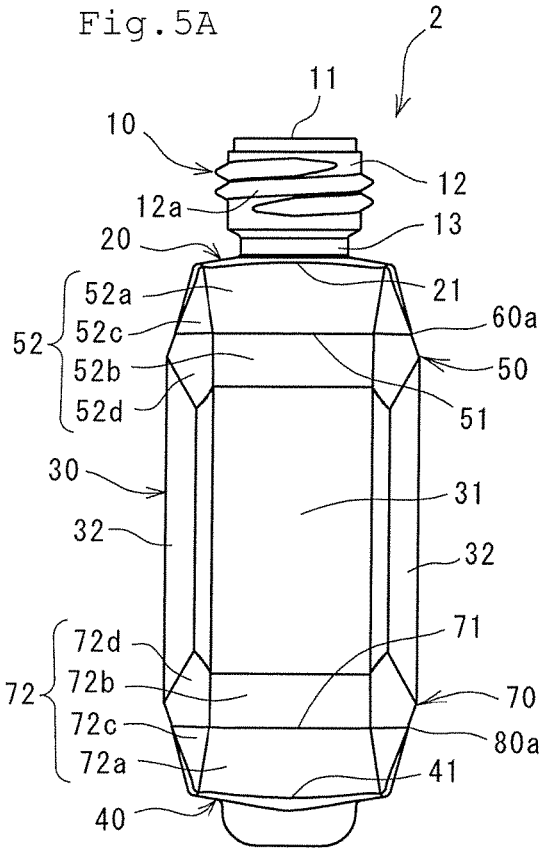
FIGS. 5A to 5D illustrate yet another embodiment of the squeeze container of the present invention, where
Figure 5B:
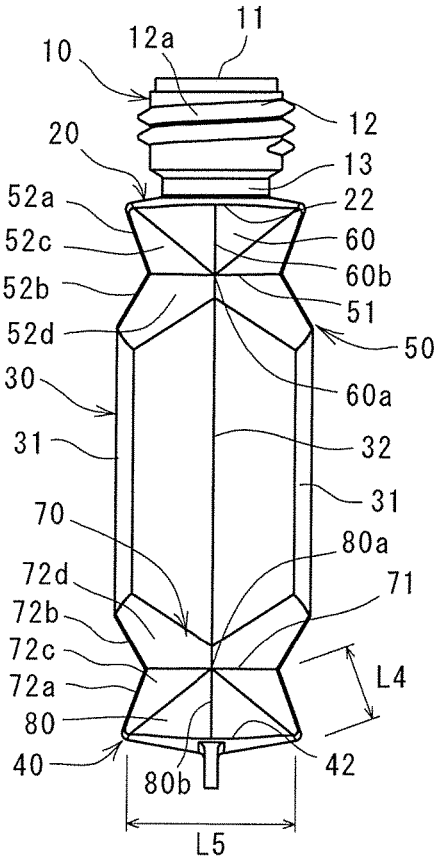
Figure 5C:
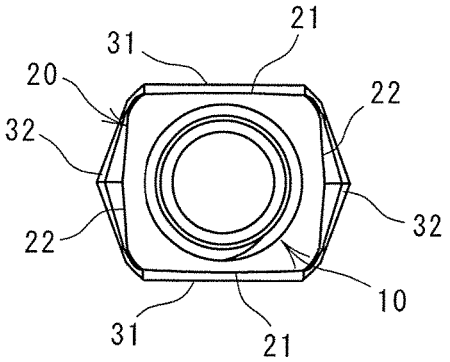
Figure 5D:
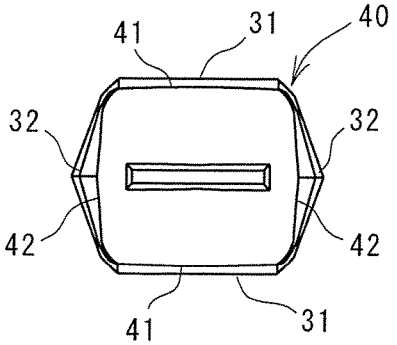

The bottom portion 40 has a substantially quadrangular shape in plan view as illustrated in FIG. 5D. Two sides parallel to each other of four sides constituting a substantially rectangular shape face the pressing portion 31 of the body portion 30. For the sake of simplicity of explanation, two sides facing the pressing portion 31 are each referred to as a main bottom edge 41, and two sides connecting the corresponding opposite ends of the main bottom edges 41 to each other are each referred to as a side bottom edge 42.

As described above, there is provided a second V-shaped groove 70 between the body portion 30 and the bottom portion 40. As illustrated in FIGS. 5A and 5B, the second V-shaped groove 70 has a groove bottom formed by a lower bending line 71 continuous in a circumferential direction in a substantially horizontal direction recessed in the central axis direction of the body portion 30 and continuing in the circumferential direction in a substantially horizontal direction, and is formed by panel portions 72 positioned above and below the lower bending line 71.

As illustrated in FIGS. 5A and 5B, the panel portions 72 includes a fifth panel portion 72*a* formed between the main bottom edge 41 of the bottom portion 40 and the lower bending line 71, a sixth panel portion 72*b* formed between the lower bending line 71 and the pressing portion 31 of the body portion 30, i.e., above the fifth panel portion 72*a*, a seventh panel portion 72*c* formed between the side bottom edge 42 of the bottom portion 40 and the lower bending line 71, i.e., on right and left sides of the fifth panel portion 72*a*, and an eighth panel portion 72*d* formed between the lower bending line 71 and the tapered portion 32 of the body portion 30, i.e., above the seventh panel portion 72*c*.

The fifth panel portion 72*a* is formed such that a vertical length L4 (a length from the main bottom edge 41 of the bottom portion 40 to the lower bending line 71) is less than half of a length L5 of the side bottom edge 42 of the bottom portion 40.

The seventh panel portion 72*c* has a substantially triangular shape in side view, and a second inclined portion 80 is positioned below the seventh panel portion 72*c*.

Ridgeline portions of the respective panel portions 72*a*, 72*b*, 72*c*, and 72*d*, and vicinities of four corners of the bottom portion 40 are each not limited to an angular shape, and may be a slightly rounded shape.

As described above, the second inclined portion 80 connects the side bottom edge 42 of the bottom portion 40 and the lower side of each of the seventh panel portions 72*c* provided symmetrically left and right in side view, and has a shape tapered upward outside, specifically, a substantially triangular shape. The second inclined portion 80 tapers from the side bottom edge 42 toward an end portion of the tapered portion 32. Then, the lower bending line 71 extends (is connected) to a tapered apex 80*a* of the second inclined portion 80.

Other structures are substantially the same as those in the previous embodiment, so that the same reference numerals are given, and description thereof is omitted.

Figure 6A:
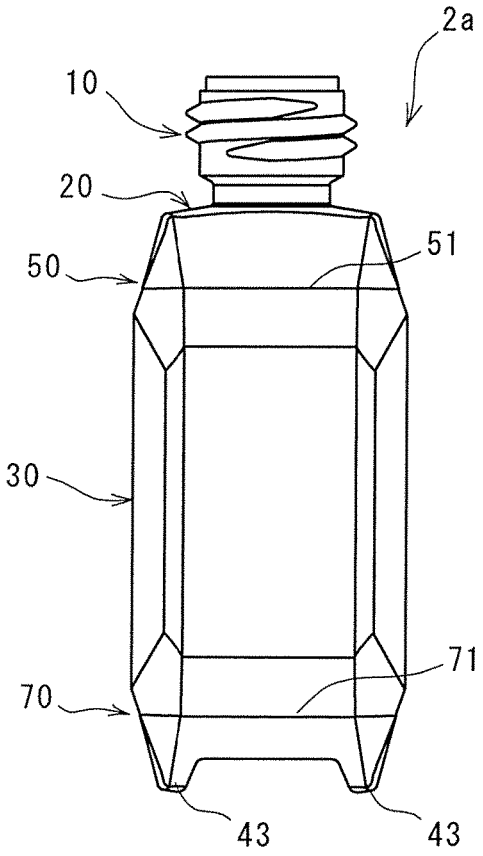
FIGS. 6A and 6B illustrate yet another embodiment of the squeeze container of the present invention, where
Figure 6B:
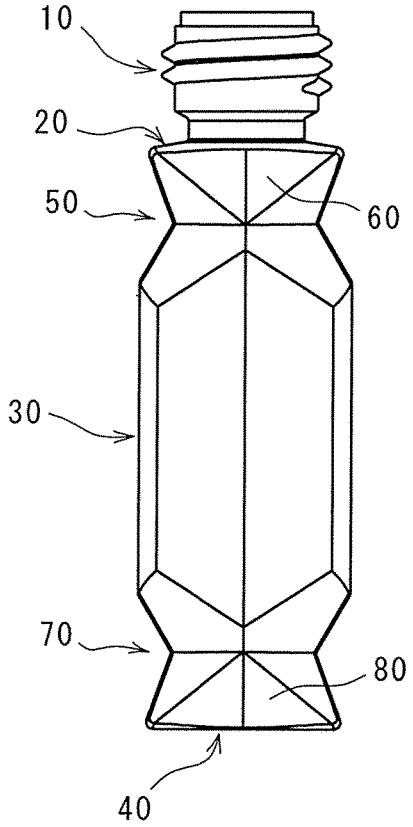

When the V-shaped groove is also formed between the body portion 30 and the bottom portion 40, it is possible to reduce the contents remaining on a bottom portion 40 side. In addition, the V-shaped grooves formed up and down achieve a good aesthetic appearance. When the bottom portion 40 is substantially horizontal, or substantially flat, like a squeeze container 2*a* illustrated in FIGS. 6A and 6B, a leg portion 43 extending downward can be provided in the bottom portion 40. In this case, the container can stand by itself.

While the representative embodiments of the present invention are described above, the present invention is not limited to the above-described embodiments, and various modifications can be made within the scope of the present invention. For example, while the squeeze containers 2 and 2*a* illustrated in FIGS. 5 and 6, respectively, are each provided with the V-shaped grooves 50 and 70 formed up and down, the V-shaped groove 70 on a bottom portion 40 side may not be provided. In addition, a shape with a flat (tapered shape) bottom portion may be adopted. As the material of the squeeze containers 1, 1*a*, 2, and 2*a*, various synthetic resin having flexibility can be used besides polyethylene resin, and plastic deformable material can be used besides synthetic resin, specifically, a metal plate or a laminate material of a metal foil and a resin. Using plastic deformable material enables a substance from outside air to be prevented from flowing into a container without providing the check valve V. Further, the planar shape of the body portion 30 is not limited to an oval shape or a hexagonal shape, and may be a polygonal shape such as a quadrangular shape or an octagonal shape.

REFERENCE SIGNS LIST

1, 1*a*, 2, 2*a* squeeze container
10 neck portion
11 opening
12 neck portion main body
12*a* thread
13 narrowed portion
20 shoulder portion
21 main shoulder edge
22 side shoulder edge
30 body portion
31 pressing portion
31*a* flat portion
32 tapered portion
40 bottom portion
41 main bottom edge
42 side bottom edge
43 leg portion
50 V-shaped groove
51 upper bending line
52 panel portion
52*a* first panel portion
52*b* second panel portion
52*c* third panel portion
52*d* fourth panel portion
60 inclined portion
60*a* apex of inclined portion
60*b* folding line
70 second V-shaped groove
71 lower bending line
72 panel portion
72*a* fifth panel portion
72*b* sixth panel portion
72*c* seventh panel portion
72*d* eighth panel portion
80 second inclined portion
80*a* apex of inclined portion
80*b* folding line
L1 length of first panel portion
L2 length of side shoulder edge
L3 length of inclined portion
L4 length of fifth panel portion
L5 length of side bottom edge
C cap
N droplet nozzle
V check valve

The invention claimed is:

1. A squeeze container comprising:

an open cylindrical neck portion;

a shoulder portion extending substantially horizontally from a base end of the neck portion;

a body portion provided below the shoulder portion; and a bottom portion provided below the body portion, wherein the body portion is compressed back and forth from outside to discharge contents, the body portion has a shape of a polygon or an oval tapered in a left-right direction in plan view, the body portion includes a pair of front-and-back pressing portions that are disposed to face each other so as to flatten the polygon or the oval in the left-right direction by being compressed back and forth, and a pair of left-and-right tapered portions connecting the pressing portions to each other, and a pair of front-and-back V-shaped grooves are provided between each of the pressing portions of the body portion and the shoulder portion so as to face each other while being recessed in a central axis direction of the body portion and having a groove bottom formed by an upper bending line extending substantially horizontally.

2. The squeeze container according to claim 1, wherein the shoulder portion includes a pair of front-and-back main shoulder edges facing a corresponding pair of front-and-back pressing portions and a pair of left-and-right side shoulder edges connecting a corresponding opposite ends of the front-and-back main shoulder edges to each other, the V-shaped grooves are provided symmetrically front and back between the main shoulder edges of the shoulder portion and a corresponding pressing portions of the body portion, inclined portions each in a shape tapered downward outside are provided symmetrically left and right between the side shoulder edges of the shoulder portion and a corresponding tapered portions of the body portion, the inclined portion has a shape tapered from the side shoulder edge toward the end portion of the tapered portion, and the upper bending line extends to a tapered apex of the inclined portion or to a lower vicinity of the tapered apex.

3. The squeeze container according to claim 1, wherein the bottom portion extends substantially horizontally, and a pair of front-and-back second V-shaped grooves are provided so as to face each other between each of the pressing portions of the body portion and the bottom portion while being recessed in the central axis direction of the body portion and having a groove bottom formed by a lower bending line extending substantially horizontally.

4. The squeeze container according to claim 3, wherein the bottom portion includes a pair of front-and-back main bottom edges facing a corresponding pair of front-and-back pressing portions and a pair of left-and-right side bottom edges connecting a corresponding opposite ends of the front-and-back main bottom edges to each other, the second V-shaped grooves are provided symmetrically front and back between the main bottom edges of the bottom portion and a corresponding pressing portions of the body portion, second inclined portions each in a shape tapered upward outside are provided symmetrically left and right between the side bottom edges of the bottom portion and a corresponding tapered portions of the body portion, the second inclined portion has a shape tapered from the side bottom edge toward the end portion of the tapered portion, and the lower bending line extends to a tapered apex of the second inclined portion or to an upper vicinity of the tapered apex.

5. The squeeze container according to claim 1, wherein a leg portion extending downward is provided in the bottom portion.

6. The squeeze container according to claim 1, wherein a droplet nozzle is provided in the neck portion.

7. The squeeze container according to claim 1, wherein the body portion is configured so as not to be restored after being compressed.

8. The squeeze container according to claim 7, wherein the neck portion is provided with a check valve for allowing a flow from inside to outside and blocking a flow from outside to inside.

9. The squeeze container according to claim 7, wherein the squeeze container is made of a plastic deformable material.

10. The squeeze container according to claim 1, wherein the neck portion includes a cylindrical neck portion main body and a narrowed portion reduced in diameter below the neck portion main body.

11. The squeeze container according to claim 1, wherein an internal space is filled with medicine by 15 to 85% of a full volume.

* * * * *